US006666012B2

(12) United States Patent
Widner et al.

(10) Patent No.: US 6,666,012 B2
(45) Date of Patent: Dec. 23, 2003

(54) PROCESS AND DEVICE FOR PNEUMATIC RETENTION OF A YARN

(75) Inventors: Harald Widner, Ingolstadt (DE); Sebastian Brandl, Böhmfeld (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 262 days.

(21) Appl. No.: 09/796,101

(22) Filed: Feb. 28, 2001

(65) Prior Publication Data

US 2002/0020456 A1 Feb. 21, 2002

(30) Foreign Application Priority Data

Mar. 2, 2000 (DE) ..... 100 10 196

(51) Int. Cl.[7] ..... B65H 57/00; B65H 69/06

(52) U.S. Cl. ..... 57/353; 57/22; 57/263; 57/265

(58) Field of Search ..... 57/22, 23, 261–265, 57/304, 305, 353; 226/97.4; 242/475.4, 475.6

(56) References Cited

U.S. PATENT DOCUMENTS

| | | | | |
|---|---|---|---|---|
| 3,924,394 A | | 12/1975 | Stahlecker et al. | |
| 4,528,808 A | | 7/1985 | Luz | |
| 5,115,629 A | | 5/1992 | Zumfeld | |
| 5,765,770 A | * | 6/1998 | Hermanns et al. | 242/476 |
| 5,862,660 A | * | 1/1999 | Haasen et al. | 57/22 |
| 5,927,061 A | * | 7/1999 | Greis | 57/263 |
| 6,298,647 B1 | * | 10/2001 | Ruskens et al. | 57/22 |
| 2001/0003894 A1 | * | 6/2001 | Premi | 57/22 |

FOREIGN PATENT DOCUMENTS

| | | | | |
|---|---|---|---|---|
| DE | 4027184 A1 | | 3/1991 | |
| DE | 4027184 A | * | 3/1991 | B65H/69/06 |
| DE | 4224633 A1 | | 1/1994 | |
| DE | 4224633 A | * | 1/1994 | |
| DE | 4300586 A1 | | 7/1994 | |

OTHER PUBLICATIONS

German Search Report dated Jun. 8, 2000.

* cited by examiner

*Primary Examiner*—John J. Calvert
*Assistant Examiner*—Shaun R Hurley
(74) *Attorney, Agent, or Firm*—Dority & Manning, P.A.

(57) ABSTRACT

During the pneumatic holding of a yarn spun from fibers, the intensity of the air stream holding the yarn is changed to adapt to the prevailing working conditions. Such a change in intensity of this air stream can take place here in adaptation to different work phases and/or to the character of the held yarn. In order to reduce the intensity of the air stream, a secondary air stream may be fed to it at a point which is not reached by the yarn held by the air stream, or the cross-section of a pneumatic device conveying the air stream is changed. The pneumatic device is associated with an air control device which influences the intensity of the air stream and is connected to a control device which can be adjusted or programmed to take various working conditions into account. By means of the air control device an opening can be controlled through which the line can be connected to the atmosphere surrounding it. Alternatively, the air control device 9 can be provided with a choke which changes the cross-section of the pneumatic device.

33 Claims, 2 Drawing Sheets

PROCESS AND DEVICE FOR PNEUMATIC RETENTION OF A YARN

BACKGROUND OF THE INVENTION

The present invention relates to a process for pneumatic holding of yarn spun from fibers under different work conditions as well to a device to carry out this process.

In textile machines, in particular in spinning machines such as open-end spinning machines, it is customary to hold a yarn by means of suction air (DE 23 50 843 A1) to carry out a given work phase. For example, the yarn is cut, merely stored, or transferred from one position to another during this work phase. In this process, the problem occurs, however, that the end of the pneumatically held yarn is affected by the air stream and therefore less than perfect quality is available for the subsequent work steps, so that errors in work or even interruption of the work process may result.

OBJECTS AND SUMMARY OF THE INVENTION

It is the principal object of the present invention to create a process and a device by means of which excessive stress on and thereby damage to the yarn end, and thus a disturbance of the work process resulting from such damage, may be avoided. Additional objects and advantages of the invention will be set forth in part in the following description, or may be obvious from the description, or may be learned through practice of the invention.

This principal object is attained by the invention through adapting the intensity of the air stream holding the yarn to the prevailing work conditions. Due to the fact that the intensity of the airflow brought to bear upon the yarn is adapted to the current operating conditions, the lowest possible intensity of the air stream can be selected for this purpose. The yarn is treated with care in the time interval during which it is exposed to the air stream, while the intensity of the air stream remains strong enough to carry out its task reliably.

The term "working conditions" is not only to be understood in the sense of the present invention to relate to the work phases following the pneumatic holding of the yarn, but also relates to the different yarn characteristics with regard to yarn thickness, fiber material spun into the yarn and yarn structure as well as yarn twist, fiber incorporation, etc.

The working conditions may be different depending on the textile conditions and/or the operating position. Therefore, it is possible according to an advantageous embodiment of the process to change the intensity of the air stream brought to bear on the yarn end in work phases following each other in time and in adaptation to the task to be accomplished in that case. This change of intensity allows secure handling of the yarn with the least possible flow intensity in an optimal manner.

Complementing or as an alternative to, an adaptation of the flow intensity to different work phases, it is an advantageous to adapt the air stream acting upon the yarn end to the character of the yarn. The "character of the yarn" in this case should be understood to be the yarn thickness, the fiber material spun into the yarn, the twist of the yarn or its structure, etc., which may show considerable differences, depending on the spinning process used.

According to the invention, the air stream for the reception of a yarn is set at a high intensity, since the task to be accomplished as a rule consists of releasing the yarn from the influence zone of another element in which it is held by that element. In addition, the air stream does not necessarily act upon the end of such a yarn to be accepted, but in some cases upon a middle area of the yarn, so that the latter must be taken up in form of a loop. For this process, an intensive air stream is useful.

In a further development according to the invention of the described process, the yarn to be cut is held under tension by an air stream of high intensity, so that the cutting point is accordingly determined very precisely as related to the yarn to be cut.

If the task consists merely in holding the yarn after cutting, the intensity is maintained advantageously only until the severed yarn end has been removed. The intensity is then reduced to a value sufficient for the yarn end formed by the cutting process to be held securely on the one hand, while, on the other hand, it is exposed to the lowest possible air stream so that the yarn end may not be frayed and may essentially preserve its character. In an advantageous further development of the process according to the invention, such a reduction of the air stream intensity is effected before the yarn is taken out of the range of influence of the air stream. This reduction occurs whether or not the yarn was to be cut in the pipe in which it had been held previously.

In order to reduce the air stream acting upon the yarn, a secondary air stream can be fed to this air stream outside the area in which the yarn is located.

In another advantageous variation of the described process, the cross-section of a line conveying the yarn and the air stream can be changed to control the intensity of the air stream acting upon the yarn.

To carry out the process, a device for pneumatic holding of a yarn by means of a line connected to an air source is used. Thanks to the air control device according to the invention it is possible to control the air stream which can be brought to bear upon the yarn in such manner that it is as weak as possible on the one hand, while on the other hand it is strong enough that it securely holds the yarn as required by the current operating conditions in an optimal manner.

The air control device can be designed in different ways. Thus, it is possible to design the air control device of the object of the invention in an advantageous manner using control openings or chokes. Beyond this, it is possible with the design of the air control device of the invention to actuate one or several intermediate positions in addition to the two end positions that can also be adjustable. In that case, it is advantageous to provide a monitoring device to adapt the intensity of the airflow to different yarn thicknesses.

In addition, a yarn severing device can be assigned to the air control device and, if applicable, can be an integral part of the air control device.

The process and the device according to the invention make it possible in a simple and optimal manner to hold the yarn carefully. The process and the device are based on the realization that, in adapting the air stream to different operating conditions, it is possible to hold the yarn securely, depending on the prevailing operating conditions, when the intensity of the airflow is as strong as possible as well as when it is reduced. This not only results in a careful treatment of the yarn but, depending on the design of the air control device, also in savings in energy, since the air source need provide less air for certain operating conditions than for other operating conditions.

Examples of embodiments of the invention are explained below through drawings.

DETAILED DESCRIPTION

Reference will now be made in detail to the presently preferred embodiments of the invention, one or more examples of which are shown in the figures. Each example is provided to explain the invention, and not as a limitation of the invention. In fact, features illustrated or described as part of one embodiment can be used with another embodiment to yield still a further embodiment. It is intended that the present invention cover such modifications and variations.

Figure 1:
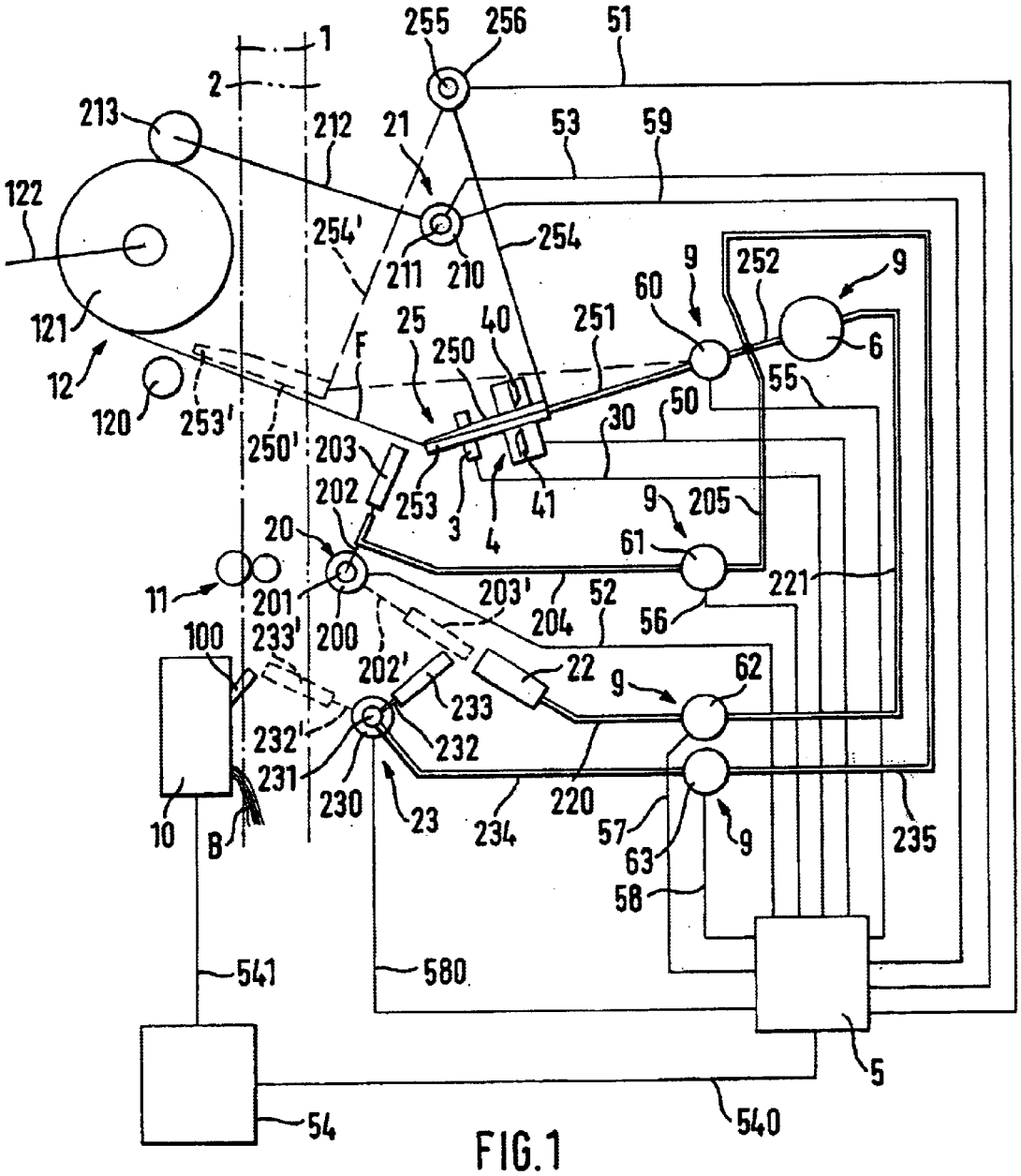
FIG. 1 shows an open-end spinning station as well as a service unit with an air control device according to the invention, shown in a schematic side view.

The device according to the invention is explained below through the example of an open-end spinning machine. On this machine, FIG. 1 shows a workstation 1 on the left by means of a line of alternating dashes and dots, while a service unit 2 is indicated on the right side of the figure by means of a dash-dot-dot line. Normally, an open-end spinning machine has a plurality of identical workstations 1 adjoining each other along which the service unit can be moved.

The workstation 1 of an open-end spinning machine selected as an example shows only a schematically drawn open-end spinning device 10 which is fed a fiber sliver B during spinning operation. The fiber sliver B is opened in a known manner into individual fibers in the open-end spinning device 10, and these are then incorporated continuously into the end of a yarn (not shown).

The open-end spinning device 10 is provided with a yarn draw-off pipe 100 through which the spun yarn is drawn off by means of a draw-off device 11 from the open-end spinning device 10. In the direction of yam draw-off towards the draw-off device 11, a winding device 12 is provided with a winding roller 120 by means of which a package, or a bobbin, 121 can be driven for the winding of the yarn spun in the open-end spinning device 10. For this purpose, the bobbin 121 is mounted so as to be capable of rotation between two bobbin holders 122. By swinging the bobbin holders 122 the bobbin 121 can be lifted off from the winding roller.

The service unit 2 is provided with a yarn take-up device 25 with a suction pipe 250 which is connected to an air source 6 via a suction line 251 and a connection line 252. Between the suction line 251 and the connection line 252 is a valve 60 by means of which the negative pressure which can act in the suction pipe 250 can be controlled. The valve 60 is connected for control to a control device 5 by means of a line 55.

In the embodiment shown, the suction pipe 250 has an outlet 253 which extends parallel to the surface line of the bobbin 121 over the entire length of the latter.

The suction pipe 250 is mounted on a swivel axis 255 so that it can be swiveled by means of a swivel arm 254. The swivel arm is associated with a swivel drive 256 which is connected for control to the control device 5 by means of a control line 51.

In the embodiment shown, the suction pipe 250 is furthermore assigned to a yarn-severing device 4 with, e.g., two blades 40 and 41 interacting in the manner of scissors. The yarn-severing device 4 is provided with a drive (not shown) which is connected for control via a control line 50 to the control device 5.

A yarn transfer device 20 with a swivel arm drive 200 of a swivel arm 202 with a suction pipe 203 at its end and mounted on a swivel axis 201 is connected for control via an additional control line 52 to the control device 5. This suction pipe 203 is connected via a negative-pressure line 204 to a valve 61 which is connected to the connection line 252 by means of a connection line 205. The valve 61 is connected via a control line 56 to the control device 5.

By swiveling it, the suction pipe 203 can be presented to a yarn end preparation device 22 fixedly installed in the service unit 2. The yarn end preparation device 22 is connected via an overpressure line 220, a valve 62, and a connection line 221 to the overpressure side of the air source 6. The valve 62 is connected via a control line 57 to the control device 5.

Another yarn transfer device 23 with a swivel drive 230 and a swivel arm 232 mounted on a swivel axle 231 supports a suction pipe 233 at its free end. This suction pipe is connected via a negative-pressure line 234 to a valve 63 which in turn is connected via a connection line 235 to the connection line 252. The valve 63 is connected via a control line 58 to the control device 5 with which the swivel drive 230 is also connected for control via a control line 580.

The valves 60, 61, 62 and 63 thus assume in turn one after the other the function of an air control device 9 as explained below.

An auxiliary drive 21 of the bobbin 121 is furthermore connected via a first control line 53 with its swivel drive 210 to the control device 5. The swivel drive 210 is assigned to a swivel arm 212 mounted on a swivel axle 211. The swivel arm 212 supports on its free end an auxiliary drive roller 213 driven in a conventional manner. This auxiliary drive roller 213 can be presented to the bobbin 121 when the latter is lifted off from the winding roller 120 in order to drive the bobbin 121 in a known manner during a yarn search or for renewed winding up of a pieced yarn. To control this drive of the auxiliary drive roller 213, the auxiliary drive 21 is connected via a second control line 59 to the control device 5.

The structure of the service unit 2 has been described above only to the extent absolutely necessary to understand the object of the invention. It goes without saying that the service unit 2 contains in addition, in a known manner, a plurality of other devices, aggregates lines, etc., not shown which are of no interest here.

The control device 5 is connected via a control line 540 to a higher-order control device 54 which controls and monitors the aggregate and devices of the open-end spinning machine and in particular of their workstations 1 (see control line 541). The control device 5 and/or its higher-order control device 54 are programmed in such manner (by adjustment or by means of a suitably designed software) that it brings the air control device 9 (valves 60, 61, 63 and 63) in timely sequence into the necessary position to control the intensity of the air stream to be brought to bear on the yarn F.

Figure 4:
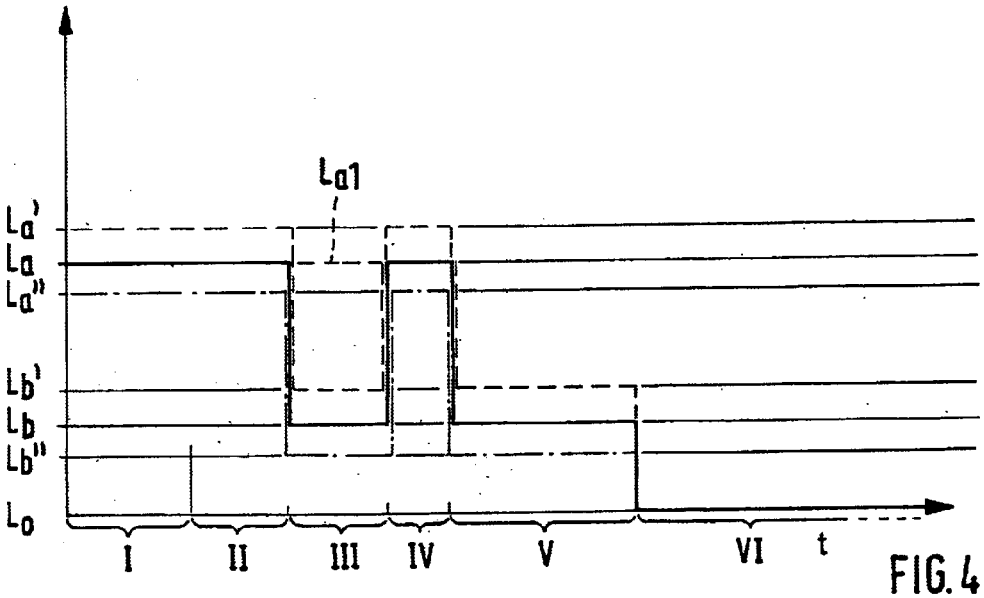
FIG. 4 shows a diagram of the intensity of the air stream in function of different operating conditions.

The operation of the device, the structure of which has been described above, shall be explained below with the help of FIGS. 1 and 4. On its ordinate, FIG. 4 shows the intensity of the air stream L. On its abscissa (time axis t), FIG. 4 shows different work phases I, II, III, IV, V and VI, during which the yarn F is located within the yarn take-up device 25 which is chosen here to stand for other yarn take-up devices (e.g., 24) or yarn transfer devices (e.g., 20, 23), where the control of the air intensity is effected in similar manner.

For the description below of the device whose structure is described above, it shall be assumed that breakage of the drawn-off yarn has occurred at the shown work station 1 and that the spinning process has been interrupted as a result. At the same time, the feeding of the fiber sliver B to the open-end spinning device 10 is interrupted. Furthermore, the bobbin 121 is lifted from the winding roller 120 by swiveling the bobbin holders 122 and is thereby stopped.

When the service unit 2 reaches the affected workstation 1 and stops there on its patrol along the open-end spinning machine or as a result of a call-up signal normally triggered in case of a yarn breakage, the piecing process is initiated. For this process, the auxiliary drive roller 213, controlled by the control device. 5 (first control line 53), is brought to bear upon the bobbin 121 which has been lifted away from the winding roller 120. The auxiliary drive roller 213 is now driven in such manner (second control line 59) that the bobbin 121 rotates in counterclockwise direction as shown in the drawing of FIG. 1.

Simultaneously with the presentation of the auxiliary drive roller 213 to the bobbin 121, the swivel arm 254 with the suction pipe 250 under control by the control device 5 (control line 51) is swiveled towards the bobbin 121 that has been lifted away from the winding roller 120 (see the positions 254', 250' of the swivel arm 254 and of the suction pipe 250 whose outlet 253 now assumes the yarn receiving position 253', these positions being indicated by broken lines). A negative pressure is produced in the suction pipe 250 through actuation of the valve 60 (control line 55).

When the bobbin 121 is now driven in a counterclockwise direction by the auxiliary drive roller 213, the yarn end E (not shown in FIG. 1) located on the bobbin surface reaches the area of the outlet 253 of the suction pipe 250 which is presented to the bobbin 121 (see yarn receiving position 253'). The yarn end E is then sucked into outlet 253 due to the negative pressure prevailing in this suction pipe 250.

Since the yarn end E has been "rolled into" the windings of the yarn wound on the bobbin 121 to a certain degree by the rotation of the bobbin 121 between the moment at which the yarn breakage occurs and the lifting of the bobbin 121 from the winding roller 120 and its reaching a stopped position, the yarn end E must first be disengaged from these windings on the bobbin 121. For this reason, the valve 60 between the suction line 251 and the connection line 252 is adjusted before the take-up of the yarn F (control line 55) so that a suction air stream of higher intensity flows in the suction pipe 250 and thereby also at its outlet 253 (see flow intensity $L_a$ in FIG. 4; phase I: yarn take-up). This strong suction airflow seizes the yarn end E and pulls it further into the suction pipe 250. At the same time, due to the rotation of the bobbin 121 imparted to it by the auxiliary drive roller 213, an ever greater length of the yarn F comes within the zone of influence of this air stream L sucked into the suction pipe 250 and the yarn F is carried off by it.

When the suction pipe 250 has taken up securely and in sufficient length the yarn F unwound from the bobbin 121, the swivel arm 254 (control line 51) is swiveled so that the suction pipe 250 moves with its outlet 253 away from the bobbin 121 (Phase II: swiveling of the yarn take-up device 25). When this swiveling of the yarn take-up device 25 has caused the yarn F to be deflected more at the outlet 253 of the suction pipe 250, the friction or retention force acting upon the yarn F is so great that the intensity of the air stream L can be lowered if the circumferential speed of the bobbin 121 substantially matches the swiveling speed of the yarn take-up device 25 (see flow intensity $L_b$ in phase III: continued swiveling of the yarn take-up device 25). Since the yarn F has not yet been shortened at this point in time by the yarn-severing device 4, the reduction of the flow intensity can be dispensed with during this phase III (see flow intensity $L_{a1}$ in phase III, indicated by broken lines).

Finally, the yarn take-up device 25 assumes the yarn transfer position, indicated in FIG. 1 by a solid line, in which the yarn F is released at a given time for further handling and is later transferred to the yarn transfer device 20. When this yarn transfer position has been reached, the drive of the auxiliary drive roller 213 and thereby also the bobbin 121 is stopped (control line 59).

At a point in time coordinated with the piecing process, the yarn-severing device 4 (control line 50) is actuated by the control device 5 so that the blades 40 and 41 execute a movement relative to each other and sever the yarn F located between them (phase IV: yarn severing process and removal of the severed yarn end). For this severing of the yarn F, it should assume as stretched a position as possible within the suction pipe 250 so that the length of the yarn F extending from the bobbin 121 to the yarn-severing device 4 may be defined exactly. For this reason, the negative pressure in the area of the suction pipe 250 has as before a high airflow intensity $L_a$. The reduced airflow intensity $L_b$ of the air stream L holding the yarn F during the phase III is increased by adjusting the valve 60 (control line 55). In the case of this high intensity being maintained during phase III (airflow intensity $L_{a1}$), the air flow intensity continues to be held at this high suction level.

Following the severing and removal of the yarn end E, the intensity of the air stream L is reduced. This reduction is effected through appropriate actuation of the valve 60 (control line 55) (Phase V: holding of the shortened yarn end). In this manner, the yarn F held in the suction pipe 250 is no longer exposed to an aggressive air stream. The intensity of the airflow is lowered as far as possible (flow intensity $L_b$) without affecting the holding of the yarn F and can, among other things, also assume a different value than during phase III. The yarn F is held securely in this manner, as before, by the prevailing negative pressure and the suction air stream flowing through the suction pipe 250. Thus the yarn F is held in a careful manner so that the free yarn end E is not untwisted thanks to the lowered flow intensity $L_b$ of the air stream L. This lowered flow intensity $L_b$ allows the former structure and twist of the yarn end E to be maintained.

At the latest, when the yarn F has been shortened to a predetermined length by severing its yarn end E, the swivel drive 200 of the yarn transfer device 20 is triggered by the control device 5 via the control line 52 in such manner that it reaches the yarn take-up position (indicated in FIG. 1 by a full line). By partial or complete closing of the valve 60 (control line 55), the intensity of the air stream L is further reduced, if necessary down to a value of zero (flow intensity $L_0$), and the yarn F which had been held until then by the suction pipe 250 is released (phase VI: release of the yarn). Simultaneously, with the closing of valve 60, the valve 61 (control line 56) is opened so that a suction air stream of high intensity flows in the suction pipe 203, causing the yarn F released from the suction pipe 250 to be sucked into the suction pipe 203. The work phases and flow intensities relating to the yarn transfer device 23 are not shown in FIG. 4, as already indicated.

The suction pipe 203 is brought into its yarn transfer position through renewed actuation of the swivel drive 200 (control line 52) (see positions 202' and 203' of the swivel arm 202 and of the suction pipe 203 indicated by broken lines). In this position, the outlet of the suction pipe 203 is located across from the outlet of the yarn end preparation device 22.

The yarn end preparation device 22 is connected to an overpressure line 220 which is configured with the yarn end preparation device 22 in the form of an injector (not shown) in such manner that a sucking action is produced at the outlet of the yarn end preparation device 22 towards the suction pipe 203. When the suction air stream in the suction pipe 203 is taken out of action by closing the valve 61 (control line 56) and an air stream flowing into the yarn end preparation device 22 is produced at the same time through actuation of valve 62, the yarn F released from the suction pipe 203 will follow this air stream and will enter the yarn end preparation device 22. The compressed-air stream, which is introduced with great intensity and possibly with tangential orientation components in the form of one or several injector openings (not shown) into the yarn end preparation device 22, acts in a known manner on the yarn end E to thin it out in the desired manner for subsequent piecing. When this preparatory action has been accomplished—as can be determined by time control or monitored optically—the intensity of the air stream acting upon the yarn end E is reduced for the remainder of the time during which the yarn end E is still held by the yarn end preparation device 22 through actuation of the valve 62 (control line 57).

Finally, the suction pipe 233 of the yarn transfer device 23 is presented to the outlet of the yarn end preparation device 22 by the control device 5 through actuation of the swivel drive 230 (control line 580). By opening valve 63 (control line 58), a negative pressure is produced in the suction pipe 233. At the same time, intensity of the air stream from the yarn end preparation device 22 acting upon the yarn end F is lowered considerably or eradicated completely through extensive or complete closing of the valve 62 (control line 57), so that the yarn F is released and thus enters into the suction pipe 233.

The suction pipe 233 is now brought into its yarn transfer position indicated by broken lines by actuating the swivel drive 230 (control line 580) (see positions 232' and 233' of the swivel arm 232 and of the suction pipe 233). A negative pressure required for the transportation of the fibers, which have been opened in a known manner from the forward end of the fiber sliver B and presented to the spinning device 10, is produced in the spinning device 10. This negative pressure takes effect as far as the outermost outlet of the yarn draw-off pipe 100 so that the free yarn end E of the yarn F held by the suction pipe 233 comes under the influence of this suction air stream flowing into the yarn draw-off pipe 100. The valve 63 is then closed (control line 58) so that the suction pipe 233 releases the yarn F. At the same time, a predetermined yarn length is fed back in one or several steps in a usual and therefore not shown manner in the direction of the yarn draw-off pipe 100. The predetermined yarn length is then sucked through the yarn draw-off pipe 100 into the spinning device 10 where the actual piecing takes place in the known manner.

The yarn F that is fed back into the spinning device 10 can be delivered by the bobbin 121 which is again driven in a back-feeding direction by the auxiliary drive roller 213. The yarn length required for piecing, however, can be provided in the form of a yarn reserve already delivered at an earlier point in time than the yarn length delivered by the bobbin 121 into the suction pipe 250. This yarn reserve is released at the proper time for the piecing, back-feeding though the yarn draw-off pipe 100 into the spinning device 10. Such a yarn reserve can also be formed during the swiveling motion of the suction pipe 203 or 233 from their position indicated in FIG. 1 by a full line into their position 203' or 233' indicated by a broken line.

Following piecing, when all the elements of the service unit 2 required for piecing have again assumed their starting position, the service unit 2 leaves the serviced workstation 1 and is again available for service at other workstations 1.

The process and the device can have many variants within the scope of the present invention, in particular by replacing individual characteristics with their equivalents or by other combinations of these characteristics or their equivalents. Thus, the work station 1 where the described process as well as the described device find their application need not be a part of an open-end spinning device 10. This process and this device can rather be used on any textile machine or device in which a yarn is to be handled, whether it is for the transportation of the yarn from one position into another (see the suction pipes 250, 203 and 233 in the described example) or for improved treatment in combination with a transportation of the yarn F from one position into another (see yarn take-up position and yarn transfer position of the suction pipe 250) or without such a yarn transportation (see yarn end preparation device 22).

The pipe receiving the yarn F also need not have an enlarged or widened outlet 253 if this pipe does not have the task of taking up the yarn F from the bobbin 121 like the suction pipe 250. This becomes clear through the above example of the suction pipes 203 and 233 where the yarn F is conveyed to the respective outlets of the suction pipes 203 or 233.

The pipe receiving the yarn F may also be a pipe through which a yarn F provided for piecing, which is not unwound from the bobbin 121, is transported from its end away from the outlet in the direction of the outlet, which in this case also need not have a greater diameter, where the yarn F is in turn grasped by a grasper or similar device and is conveyed to the yarn draw-off pipe 100.

The control of the intensity or speed of the airflow is effected according to the above description by corresponding adjustment of the valve 60, 61, 62 or 63. It is, however, also possible to adjust the intensity of the airflow by means of a central control of the air source 6, since, as the above description shows, the yarn F reaches the valves 60, 61, 62, 63, one after the other in time, whereby these valves 60, 61, 62, 63 merely have the task of switching the air stream on or off in the required zone. Depending on whether the valves 60, 61, 62, 63 or the air source 6 control the intensity of the airflow, these valves 60, 61, 62, 63 or this air source 6 constitute the air control device 9 for the air stream L acting upon the yarn.

Only one air source 6 was mentioned above, without indicating whether it supplies overpressure or negative pressure, it is because this air source 6 serves as negative pressure source or as overpressure source, depending on the connection of the connecting line 252, 205, 221, 235, etc. It goes without saying that when either negative pressure or overpressure is needed, a negative-pressure source as well as an overpressure source can be provided as autonomous air sources, i.e., independent of each other, instead of the shown combined compressed-air source 6.

By means of the yarn end preparation device 22, yarn end E is imparted an especially suitable form for piecing by untwisting or fraying. It is possible to assign the yarn end preparation device 22 to the suction pipe 250 having it located between the outlet 253 and the yarn-severing device 4.

Depending on the design and task of the pipe holding the yarn F, a yarn severing device 4 can be assigned to it functionally and thereby also to the air control device 9 (valve 60, 61, 62, 63 or air source 6). This is not obligatory, however, as appears from the above description. If it is provided, the yarn-severing device 4 can be designed in different ways, e.g., as shown, in the form of scissors, a knife, a grinding roller, etc.

In a device of this type, e.g., in the spinning device 10 shown in FIG. 1, not every yarn take-up device 24, 25 or yarn transfer device 20, 23 need necessarily serve to receive the yarn F with the assistance of a negative-pressure or overpressure air stream. Therefore, these devices do not absolutely require a suction pipe 240, 250, 203 or 233. It may also be advantageous if, e.g., a suction pipe 203 in which the intensity of the air stream L is controlled in adaptation to the different work phases I to VI interacts with a yarn transfer device 23 which is provided with a controllable holding device, e.g., a pair of rollers (not shown), instead of a suction pipe 233. If the two rollers of such a pair of rollers can be driven as needed in one or the other direction, then this pair of rollers can take over or assist the back-feeding of the yarn length required for piecing into the spinning device 10. Also, such rollers can take over or assist the start of draw-off of the yarn F following successful piecing from the spinning device 10. The yarn length required for the back-feeding to the spinning device 10 can be released by suitable reverse rotation of the bobbin 121 by means of the auxiliary drive roller 213.

Figure 2:
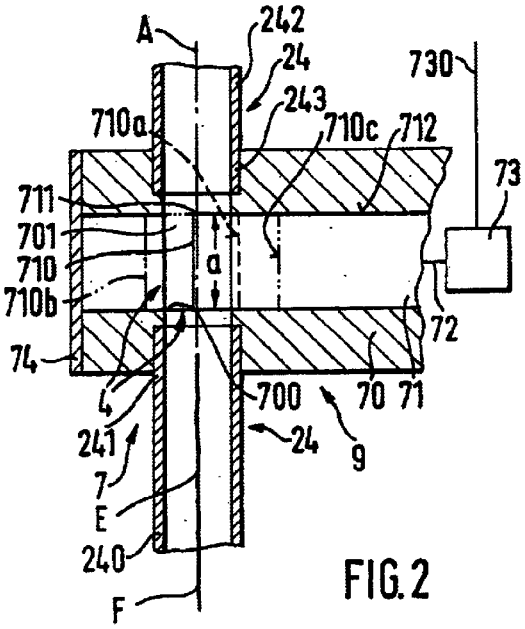
FIG. 2 shows a cross-section of an air control device according to the invention.

According to FIG. 1, a valve 60, 61, 62 or 63 located outside of the range of the length of yarn F is provided for the control of the air stream L acting upon the yarn F or the yarn end E. FIG. 2 shows in detail the example of an embodiment of a valve 7 in the form of a choke for the control of the intensity of the air stream acting upon the yarn end E. With the help of this valve, the cross-section of the line receiving the yarn F can be changed, as will be explained in further detail below. The yarn take-up device 24 shown can be in this case the yarn transfer device 20 or 23, the yarn take-up device 25, or also the yarn end preparation device 22, or can be designed as a part thereof.

The yarn take-up device 24 shown contains the previously mentioned valve 7 between a suction line 240 and a connection line 242 connected to the negative-pressure side of the air source 6. The suction line 240 and the connection line 242 are essentially aligned with each other and their two ends towards each other end in a housing 70 extending essentially perpendicularly to the longitudinal axes of the suction line 240 and the connection line 242. The housing 70 receives a ram or piston 71 which is connected via a piston rod 72 (only indicated) to a drive 73 which in turn is connected by means of a control line 730 to the control device 5 (see FIG. 1). The housing 70 is closed by a cover 74 on its side across from the drive 73.

When the full intensity of the airflow is to act upon the yarn end E, the piston 71 is with its face 710 in the position 710a indicated by a broken line. The air stream can then flow unimpeded through the suction line 240, the housing 70 and the connection line 242 and thus acts upon the yarn end E with the greatest possible intensity.

If the intensity of the air stream L brought to bear on the yarn end E is to be reduced for a given work phase I to VI, the piston 71 is pushed to the left as seen in the drawing of FIG. 2 through appropriate control by the control device 5 (control line 730), so that the cross-section in the area of housing 70 through which the air stream must flow is reduced. This causes the flow speed of air inside the housing-70 to accelerate because of the reduction of the-cross-section, but the intensity is reduced due to the throttling achieved in the area of the suction line 240. This throttling results in the airflow acting only with reduced intensity upon the yarn end E, which does not reach as far as into the housing 70 but merely extends into the suction line 240.

If desired, the valve 7 can at the same time be designed as the yarn-severing device 4, so that this yarn-severing device 4 is an integral part of the air control device 9 constituted by the valve 7. In this case, the annular edge 711 between the circumferential surface 712 and the face 710 of the piston 71 is designed as a cutting edge. In addition, the longitudinal area 701 of the housing 70 is widened by a distance between the end 241 of the suction line 240 and the end 243 of the connecting line 242, as compared with the area of the housing 70 for the movement of the piston 71. This allows an anullar edge 700, also in the form of a cutting edge, to be produced on the side of this longitudinal area 701 towards the cover 74. If the drive 73 is actuated once the yarn F has been sucked into the suction pipe 240 by corresponding control while the piston 71 is completely pulled back creating an intensively acting airflow, then the piston 71 moves to the left, relative to FIG. 2, until the yarn F is finally severed by the interacting annular edges 700 and 711 (see the position 710*b* of the face 710 indicated by a dash-dot-dot line). The piston 71 is then withdrawn immediately so that the airflow can again act upon the yarn F. Depending on the intensity of the air stream L that is desired after the severing process, the piston 71 returns here only into the position of face 710 indicated by a continuous line or into the position 710*a* indicated by a broken line.

Depending on the desired intensity of the airflow, e.g., in adaptation to different yarn thicknesses, or depending on the type of fiber material being spun, it is also possible to provide another end or intermediate position of the piston 71 which is not shown. To prevent the yarn F from being temporarily subjected to no airflow at all during the severing process, it is possible, through appropriate design of the inner contour of the housing 70 and/or of the piston 71 to ensure that an airflow is always maintained and acting on the yarn F without taking it out of severing range, even when the yarn-severing device 4 constituted by the annular edges 700 and 711 becomes active.

As described below, it is possible to achieve a reduction of the airflow intensity also by changing it in a manner other than by reducing the line (suction line 240, housing 70, connection line 242) conveying the air stream L. Thus, it is possible to achieve a reduction of the intensity of the air stream L acting upon the yarn end E when the yarn end E extends not only into the suction line 240 but as far as into the longitudinal area 701 of the housing 70, by enlarging the cross-section of the housing 70 in that longitudinal area 701. In that case, the piston 71 is not only withdrawn to the position 710a indicated by a broken line in which the face 710 is essentially in prolongation of the inner walls of the suction pipe 240 and of the connection pipe 242, but beyond this in direction of drive 73 into position 710*c*, so that a significant enlargement of the cross-section of the housing 70 is achieved. Large enough sizing of the longitudinal area 701 of the housing 70 in the longitudinal fiber direction indicated by axis A in FIG. 2 is naturally required for this.

Another alternative embodiment of a valve 8 for the control of the intensity of the air stream L acting upon the yarn end E is described below through FIG. 3. Here too the suction line 240 of a yarn take-up device 24 as well as the connection lines 242 are shown, whose ends 241 and 243 face each other leaving a distance between them. These ends 241 and 243 are surrounded by a sleeve 80 which can be displaced in longitudinal direction along axis A and which, in its shown end position, closes the space 81 created by the distance between the ends 241 and 243 radially against the outside. On a portion of its circumference, the sleeve 80 is provided with an opening 82 which can be moved by axial displacement of the sleeve 8 from its shown end position to a position 82a indicated by a broken line in which the space 81 is connected to the atmosphere or environmental air surrounding the sleeve 80.

Figure 3:
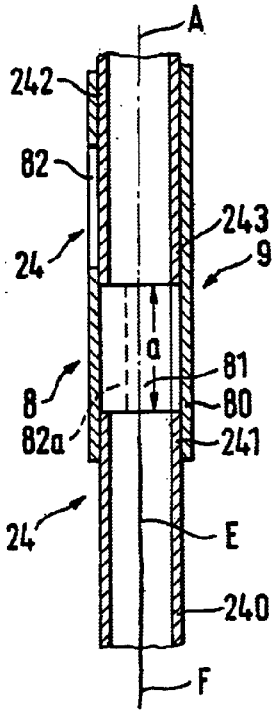
FIG. 3 shows a cross-section of a variant of an air control device according to the invention.

As shown in FIG. 3, the yarn F to be held extends with its yarn end E into the suction pipe 240 and does not reach as far as the space 81.

If an air stream of high intensity is needed for the reception or handling of the yarn F, the space 81 is closed off from the outside by moving the sleeve 80 into the position shown in FIG. 3 by a continuous line, without changing the capacity of the air source. If on the contrary, a weaker negative pressure is needed to hold the yarn F in a given work phase, the sleeve 80 is moved by the control device 5 into a position in which the space 81 is opened to the desired extent to the air surrounding the valve 8. In this manner, an air stream (secondary air stream) flows through the freed opening between the ends 241 and 243 of the suction line 240 and the connection line 242 into the space 81, so that the intensity of the airflow is reduced correspondingly in the area of the suction line 240 in which the yarn end E is located. If a greater intensity of the air stream L is again required in the area of the yarn end E, the sleeve 80 is moved back into its starting position.

So far it has only been stated that the intensity of the negative pressure is modified in the area of yarn end E in adaptation to different work phases I to VI so that it is able to fully play its role, but still is kept as low as possible so that the yarn end E subjected to the air stream L caused by the negative pressure is held with the greatest care. In addition, it must also be considered that such an adaptation of the air stream intensity L can also be applied to other work conditions besides the work phase. For example, a thin yarn F naturally reacts with much greater sensitivity to such an air stream than a thick yarn F. For this reason, provisions are made to adapt the intensity of the air stream not only to the different work phases I to VI, but, if necessary, also as a function of the thickness of the held yarn F. This level of the intensity of the air stream L can first be determined empirically and can then be adjusted manually. It is, however, also possible to provide a sensor in the yarn holding device. Such a sensor (monitoring device 3) is shown in FIG. 1 in connection with the yarn take-up device 25. This monitoring device 3 is connected for control via a control line 30 to the control device 5. It has the task of determining the yarn thickness and transmitting it to the control device 5 which adjusts to the full or the reduced intensity of the air stream L as a function of this ascertained yarn thickness. For this purpose, the air control device 9 (valve 60, 61, 62, 63, 7 or 8) is brought into a corresponding intermediate position or is driven at the corresponding rotational speed (air source 6).

In FIG. 1 for example, with reference to the above-mentioned phases I to VI, $L_a$, designates the maximum flow intensity with a thick yarn F and $L_a$" designates the maximum flow intensity with a thin yarn F, while $L_b$, designates the reduced flow intensity with a thick yarn F and $L_b$, designates the reduced flow intensity with a thin yarn F. Of course, the values for and the relationships between the flow intensities $L_a$, $L_a$', $L_a$ " on the one hand and the flow intensities $L_b$, $L_b$', $L_b$' on the other hand can be selected as a function of the prevailing conditions.

Similarly, an adaptation to the character of the yarn with regard to the type of fiber material spun and/or to the yarn twist can be taken into account in determining the flow intensity of the air stream L. The structure of the yarn F that is different, e.g., in a wrap-around yarn or in an open-end yarn or in a yarn spun on a ring-spinning machine, is to be taken into account.

Depending on the type of textile machine, the workstation 1 can be designed in different ways. Thus, the work station 1 could be part of a spinning machine, a winding machine, or other similar device. Accordingly, the service unit 2 would then also be designed differently and could also be an integral component of the work station 1 if necessary.

It will be appreciated by those skilled in the art that various modifications and variations can be made in the present invention without departing from the scope of the invention. It is intended that the present invention include such modifications and variations as come within the scope of the appended claims and their equivalents.

What is claimed is:

1. A process within a textile machine for handling a yarn spun from fibers, said process comprising the steps of:

retrieving a yarn end of the yarn during a work phase of the textile machine by at least one pneumatic device which uses at least one airflow stream;

holding the yarn for processing using the airflow stream of the pneumatic device;

controlling the airflow stream of the pneumatic device; and adjusting an intensity of the sustained airflow stream holding the yarn as a function of the work phases of the textile machine associated with handling the yarn to maintain a desired quality of the yarn.

2. A process as in claim 1, further comprising adjusting the intensity of the airflow stream to adapt to other prevailing work conditions.

3. A process as in claim 2, wherein the airflow stream is adjusted to adapt to characteristics of the yarn.

4. A process as in claim 1, wherein the airflow stream is adjusted to a high intensity for retrieving the yarn.

5. A process as in claim 4, wherein the step of retrieving the yam comprises taking up the yarn end from a package of the yarn.

6. A process as in claim 1, further comprising severing the yarn while the yarn is held by the pneumatic device.

7. A process as in claim 6, wherein the airflow stream possesses a high intensity during the step of severing the yarn.

8. A process as in claim 7, wherein the intensity of airflow stream is reduced after removal of a yarn segment created by the severing of the yarn.

9. A process as in claim 8, wherein the intensity of the airflow stream is reduced in a period of time after retrieving the yarn before increasing to the high intensity in anticipation of the severing of the yarn.

10. A process as in claim 1, wherein the intensity of the airflow stream is reduced before the yarn is taken out of the range of influence of the air stream.

11. A process as in claim 1, wherein the airflow stream is created by a negative pressure.

12. A process within a textile machine for handling a yarn spun from fibers, said process comprising the steps of:

retrieving a yarn end of the yarn during a work phase of the textile machine by at least one pneumatic device which uses at least one airflow stream;

holding the yarn for processing using the airflow stream of the pneumatic device;

controlling the airflow stream of the pneumatic device;

adjusting an intensity of the airflow stream to adapt to prevailing work conditions; and wherein the airflow stream is created by an overpressure.

13. A process as in claim 1, wherein the intensity of the airflow stream is adjusted at predetermined times.

14. A process within a textile machine for handling a yarn spun from fibers, said process comprising the steps of:

retrieving a yarn end of the yarn during a work phase of the textile machine by at least one pneumatic device which uses at least one airflow stream;

holding the yarn for processing using the airflow stream of the pneumatic device;

controlling the airflow stream of the pneumatic device;

adjusting an intensity of the airflow stream to adapt to prevailing work conditions;

monitoring the work conditions for any changes to adjust the intensity of the airflow stream accordingly; and wherein the intensity of the airflow stream is adjusted at predetermined times.

15. A process as in claim 14, wherein a secondary airflow stream is introduced to a primary airflow stream at a point which the yarn does not reach, the secondary airflow stream allowing a reduction of intensity in the primary airflow stream acting on the yarn end of the yarn as required for the prevailing work conditions.

16. A process within a textile machine for handling a yarn spun from fibers, said process comprising the steps of:

retrieving a yarn end of the yarn during a work phase of the textile machine by at least one pneumatic device which uses at least one airflow stream;

holding the yarn for processing using the airflow stream of the pneumatic device;

controlling the airflow stream of the pneumatic device;

adjusting an intensity of the airflow stream to adapt to prevailing work conditions; and changing a cross-section of the airflow stream to control the intensity of the airflow stream acting on the yarn end.

17. A process as in claim 16, wherein the cross-section of the airflow stream is reduced at a point which the yarn does not reach causing a reduction of intensity of the airflow stream acting on the yarn end.

18. A process as in claim 16, wherein the cross-section of the airflow stream is enlarged in a section of the airflow stream in which the yarn end is disposed, the enlarged cross-section of the airflow stream reducing the intensity of the airflow stream acting on the yarn end.

19. A device for handling a yarn spun from fibers within a textile machine, said device comprising:

an air source integral to said textile machine, said air source producing at least one airflow stream;

at least one pneumatic device utilizing at least one airflow stream to retrieve a yarn end of said yarn and hold said yarn during work phases of said textile machine;

at least one air control device operably disposed to said pneumatic device, said air control device used to control intensity of said airflow stream flowing within said pneumatic device, adjusting said intensity of said airflow stream holding said yarn to adapt to prevailing work conditions; and a control device in communication with said air control device, said control device relaying information and instructions to said air control device concerning adjustments of said intensity of said airflow stream holding said yarn to adapt to prevailing work conditions.

20. A device as in claim 19, wherein said air source acts as said air control device.

21. A device as in claim 19, wherein said air control device defines an opening through which said airflow stream is connected to the surrounding atmosphere when said air control device is in an open position, thereby reducing said intensity of said airflow stream that is acting on said yarn end downstream from said air control device.

22. A device as in claim 19, wherein said air control device is a valve.

23. A device as in claim 22, wherein said air control device is provided with a choke which can change a cross-section of said pneumatic device to adjust said intensity of said airflow stream acting on said yarn end.

24. A device as in claim 23, wherein said cross-section of said pneumatic device can be reduced at a point which the yarn does not reach causing a reduction of said intensity of said airflow stream acting on the yarn end.

25. A device as in claim 23, wherein said cross-section of said pneumatic device conveying said airflow stream is enlarged in a section of said pneumatic device in which said yarn end is disposed, said enlarged cross-section of said pneumatic device reducing said intensity of said airflow stream acting on said yarn end.

26. A device as in claim 19, further comprising at least one sensor operably disposed to said pneumatic device and in communication with said control device, said sensor monitoring work conditions for any changes and communicating information to said control device which in turn instructs said air control device to adjust said intensity of said airflow stream.

27. A device as in claim 26, wherein said sensor detects thickness of said yarn held by said pneumatic device.

28. A device as in claim 19, wherein said control device is programmed to control said air control device in a manner in which said air control device adjusts said airflow stream according to predetermined times dependent upon said work phases of a textile machine.

29. A device as in claim 19, further comprising a yarn-severing device to cut said yarn being held by said pneumatic device.

30. A device as in claim 29, wherein said yarn severing device is integral to said pneumatic device.

31. A device as in claim 29, wherein said yarn severing device is integral to said air control device.

32. A device as in claim 19, further comprising a service unit patrolling said textile machine, said service unit housing multiple pneumatic devices for processing said yarn with said air control devices operably disposed to pneumatic devices to properly adjust said intensity of said airflow stream, wherein said pneumatic devices and said air control devices coordinatingly process said yarn to receive a desired result.

33. A process as in claim 1, further comprising monitoring the work conditions for any changes to adjust the intensity of the airflow stream accordingly.

* * * * *